US005172838A

United States Patent [19]

Rowell et al.

[11] Patent Number: 5,172,838

[45] Date of Patent: Dec. 22, 1992

[54] CHEST POUCH CAMERA CARRIER

[75] Inventors: Galen A. Rowell, Berkeley; Hans M. Wain, Truckee, both of Calif.

[73] Assignee: Photoflex, Inc., Santa Cruz, Calif.

[21] Appl. No.: 705,107

[22] Filed: May 24, 1991

[51] Int. Cl.[5] ..... A45F 3/00; A45F 3/14

[52] U.S. Cl. ..... 224/224; 224/908; 224/208; 224/236; 224/240; 224/242; 224/246; 224/247; 206/316.2; 206/816; 190/103; 383/2

[58] Field of Search ..... 224/908, 208, 224, 228, 224/235, 236, 240, 241, 242, 256, 247, 901; 206/316.2, 816, 372-375; 383/2, 80, 81, 46, 66, 78, 79; 150/119; 190/103, 114

[56] References Cited

U.S. PATENT DOCUMENTS

| | | | |
|---|---|---|---|
| 919,745 | 4/1909 | McGraw | 383/2 |
| 1,589,315 | 6/1926 | Johnston | 224/908 |
| 2,290,307 | 7/1942 | Wicker | 224/908 |
| 2,718,833 | 9/1955 | Roth | 206/316.2 |
| 2,827,095 | 3/1958 | Hepting | 206/316.2 |
| 4,096,978 | 6/1978 | Noice | 383/2 |
| 4,136,726 | 1/1979 | Lee | 206/316.2 |
| 4,267,868 | 5/1981 | Lowe | 383/2 |
| 4,545,414 | 10/1985 | Baum | 150/113 |
| 4,610,286 | 9/1986 | Cyr | 150/52 J |
| 4,919,240 | 4/1990 | Tobias | 383/2 |
| 4,923,060 | 5/1990 | Breslau | 224/908 |
| 4,928,819 | 5/1990 | Jakobsen | 224/908 |
| 5,025,965 | 6/1991 | Smith | 224/224 |
| 5,064,062 | 11/1991 | Miller | 206/316.2 |
| 5,101,974 | 4/1992 | Alwitt | 206/316.2 |

FOREIGN PATENT DOCUMENTS

| | | | |
|---|---|---|---|
| 246348 | 4/1912 | Fed. Rep. of Germany | 190/103 |
| 1078868 | 3/1960 | Fed. Rep. of Germany | 206/316.2 |

OTHER PUBLICATIONS

Tamrac TM 1987 Catalog, p. 17, item N-75.

*Primary Examiner*—Henry J. Recla
*Assistant Examiner*—Keith Kupferschmid
*Attorney, Agent, or Firm*—Michael J. Hughes

[57] ABSTRACT

A camera carrier (10) is provided, having a camera case assembly (14) with a belt assembly (18) attached thereto. The belt assembly (18) is adapted to be worn about either a photographer's chest or waist. A case lid (16) is removably attached to the camera case assembly (14). A pair of adjustment strap assemblies (42) can be adjusted by means of a pair of double "D" ring assemblies (52) to cause the camera case assembly (14) to closely support a great variety of sizes of cameras (12). A pair of recessed areas (66) in the case lid (16) permit a neck strap (68) to be worn on the camera (12) and to protrude from the camera case assembly (14) even when the case lid (16) is closed such that the neck strap (68) may be worn around the photographer's neck when the camera carrier (10) is worn about the photographer's chest. The camera carrier (10) may optionally be used as a divider within a larger conventional camera bag (84).

11 Claims, 3 Drawing Sheets

CHEST POUCH CAMERA CARRIER

TECHNICAL FIELD

The present invention relates generally to camera equipment carrying apparatus, and more particularly to an improved means for carrying a camera upon the person of a photographer. The predominant current usage of the chest pouch camera carrier of the present invention is as a means for transporting a camera comfortably outdoors, over rough or smooth terrain, and while bicycling, skiing, or in similar arduous circumstances.

BACKGROUND ART

Camera carrying cases of various types are known in the art. These are frequently either hard shelled cases or camera bags intended to carry one or several cameras along with related equipment. Because of the need to carry a considerable quantity of related equipment therein, these devices are frequently quite large and heavy, making them unsuitable for carrying over great distances, particularly when the photographer may intend to use only a single camera on a trip, thus making the great capacity of the normal camera bag a burden rather than a benefit in the application. An example of a high capacity camera carrying case is found in U.S. Pat. No. 4,610,286, issued to Cyr.

One solution to this problem has been the conventional form fitting camera case, which is molded or otherwise formed to fit the shape of a camera. These are well known in the field. However, the popularity of interchangeable camera lenses has caused these to become less popular, as such camera cases will ordinarily only fit a single camera body/lens combination properly, and it is impractical to have a different case for each body/lens combination. Another disadvantage of this type of case has been the fact that, while the capacity of larger camera cases may frequently be an excess burden, it is still desirable to have some capacity for the storage of film and a few small accessories.

Numerous devices for carrying a single camera upon the person of a photographer have been advanced in the field. For example, Tamrac, Inc., of Canoga Park, Calif. has offered at least two solutions to the problem, including a TelePak~ Adventure System which provides a pouch type container for a camera that can be worn on a waist belt or on a shoulder strap.

Alternatively, Tamrac, Inc. also offers an X-Press Strap~ Action Camera Harness which holds a camera at a "ready" position on the photographer's chest. This position is advantageous because the camera can be quickly accessed and because the camera is protected by the photographer's body, as opposed to hanging from the photographer's side where it might be more easily damaged. A chest mounted camera carrier is, essentially, as accessible as is a camera hung around the photographer's neck by a neck strap alone. However, a chest mounted camera carrier provides the additional advantage of preventing the camera from swinging around loosely and interfering with the motions of the photographer and, perhaps, damaging the camera as well. The X-Press Strap~ offers a very viable solution for its intended application. However, a need still exists for a chest type carrier which will provide padding to protect the camera for use in rugged terrain, and the like. Furthermore, a need still exists for a camera carrier of this general type which is versatile in the sense that it can be readily adapted to carry the camera on the photographer's waist or shoulder.

An important characteristic of a camera carrying system is versatility. This is particularly true since the demands of different photographers and different situations vary so greatly. The more versatile a camera carrying system is, in the sense that it can be adapted to accommodate these widely varying needs, the more useful the system would be. The previously mentioned Tamrac~ TelePak~ adventure system provides versatility in that a photographer can (by means of interchanging lens pouches, in the case of the TelePak~ adventure system) adapt the camera carrier to carry a camera with various sizes of lenses attached thereto. Furthermore, the TelePak~ adventure system is versatile in the sense that it can be carried using either a waist belt or a shoulder strap.

While the aforementioned prior art has taught that it is desirable to make a single camera carrying case such that cameras with various size lenses may be carried therein, the solutions offered have been less than totally successful in that either the camera is not closely held within the case to prevent its being knocked about therein, or else the photographer must possess a variety of accessories for adapting the case to closely fit a variety of camera body/lens combinations.

Furthermore, while the prior art has taught that it is often desirable to carry a camera on the photographer's chest, no means for doing so has been produced which provides the camera with a padded and enclosed container while still keeping the camera readily accessible.

A very important consideration concerning the versatility of camera cases involves the fact that the needs of a given photographer may vary greatly from day to day. Therefore, it is not sufficient to provide a camera case which is ideally suited to that photographer's needs at any given instant. To provide maximum utility, the photographer should be able to integrate the camera case into the totality of his or her needs and equipment such that, in those instances in which more equipment than can be carried in the small camera case is required, the small camera case combines with a larger case such that the small case does not become a redundant and unused piece of additional baggage. To the inventors' knowledge, none of the prior art small camera cases have adequately achieved this goal.

All of the prior art single camera carrying cases within the inventors' knowledge have not been sufficiently versatile to adapt to cameras having various sized lenses without having an assortment of adaptive accessories, or else they have not closely held and protected the camera therein.

No prior art camera cases, to the inventor's knowledge, have provided a means to optionally carry a camera at the ready position on a photographer's chest or to comfortably carry the camera on a waist belt.

No prior art single camera carrying cases within the inventors' knowledge have been well suited for carrying the camera within a larger case, such that the camera is easily accessible to the photographer while the small carrying case does not take up valuable space within the larger camera bag. All successful applications to date have either not been capable of holding a camera in the ready position, or else have not been adaptable to cameras having lenses of varying sizes, or else have not provided protection for the camera and storage space for film and small accessories.

DISCLOSURE OF INVENTION

Accordingly, it is an object of the present invention to provide a camera carrying case which can be worn and carried comfortably over long intervals.

It is another object of the present invention to provide a camera carrying case which can position a camera at a ready position on a photographer's chest.

It is still another object of the present invention to provide a camera carrying case which is easily adaptable for carrying cameras having lenses of different sizes.

It is yet another object of the present invention to provide a means for carrying camera equipment which is versatile in that it may be carried in a manner most convenient to the moment.

It is still another object of the present invention to provide a camera carrying case which can be quickly and easily accessed by the user while it is being carried or worn.

It is yet another object of the present invention to provide a means for carrying a single camera which has some storage space for additional small accessory items.

It is still another object of the present invention to provide a means for carrying a camera on a photographer's chest which provides some padding and protection for the camera.

It is yet another object of the present invention to provide a single camera carrying case which is adaptable to be carried inside a larger camera bag such that the camera carrying case provides additional protection to the camera without interfering with the accessibility of the camera.

It is still another object of the present invention to provide a single camera carrying case which does not waste space in a camera bag when stored therein.

It is yet another object of the present invention to provide a means for carrying camera equipment which is versatile in that a photographer can combine cases and equipment according to the needs of the moment.

It is still another object of the present invention to provide a camera carrying system which can be used in conjunction with additional camera equipment carrying devices.

Briefly, the preferred embodiment of the present invention is a chest pouch camera carrier having a generally rectangular case for containing a camera therein. A belt apparatus is attached to the case in such a manner that the case is prevented from twisting about the belt apparatus. The belt apparatus may be worn about the waist, or about the chest, of a photographer.

When the belt apparatus is worn about a photographer's chest, a removable lid may optionally be attached such that the lid will accommodate a great variety of camera sizes, and further such that the lid does not interfere with a camera strap which may be attached to the camera and worn about the photographer's neck.

A pair of size adjustment straps may be adjusted, as required, to cause the camera case to closely support essentially any size camera which may be contained within the case.

In the best presently known embodiment of the invention, a plurality of film canister loops are provided for the storage of film, and a pocket is provided in the lid for the storage of other accessory items.

When the inventive camera carrier is to be itself carried within a larger camera bag, the lid is removed such that the inventive camera carrier acts as an additional padded divider within the camera bag. Access to the camera is not impeded thereby, and the inventive camera carrier provides extra protection for the camera while not itself taking up valuable space within the camera bag.

An advantage of the present invention is that a camera is protected while it is being carried in the ready position.

A further advantage of the present invention is that cameras of various sizes are closely supported such that they are not damaged by being bounced about within the camera case.

Still another advantage of the present invention is that the belt may optionally be worn about a photographer's waist or chest.

Yet another advantage of the present invention is that the camera case may be stored within a larger camera bag with the camera therein without hindering access to the camera.

Still another advantage of the present invention is that storage for film and small accessories is provided.

Yet another advantage of the present invention is that a camera can be comfortably carried while maintaining ready and rapid accessibility.

These and other objects and advantages of the present invention will become clear to those skilled in the art in view of the description of the best presently known mode of carrying out the invention and the industrial applicability of the preferred embodiment as described herein and as illustrated in the several figures of the drawing.

BEST MODE FOR CARRYING OUT INVENTION

The best presently known mode for carrying out the invention is a chest pouch camera carrier having a camera case which is adjustable so as to closely support a camera body/lens combination therein. The case has a belt assembly for optionally carrying the camera on a photographer's waist or chest, and a lid which is optionally removable. The predominant expected usage of the inventive chest pouch camera carrier is as a component of a photographer's gear which can be optionally carried within a larger camera bag or worn on the person of the photographer when only a single camera is needed and when the photographer is engaged in activities wherein he or she does not want to be overburdened with unnecessary equipment.

Figure 1:
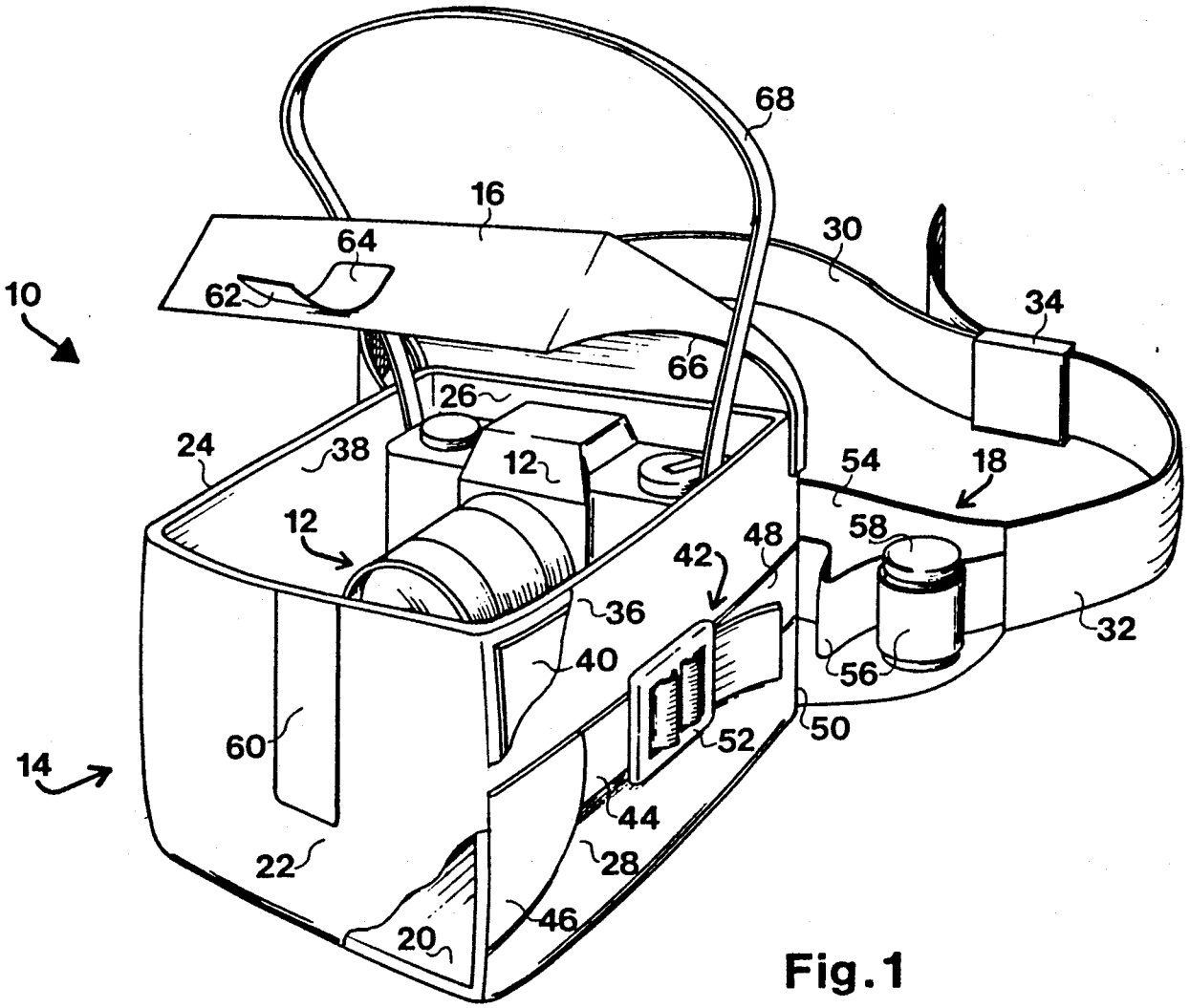
FIG. 1 is a partially cut away front perspective view of a chest pouch camera carrier, according to the present invention.

The chest pouch camera carrier of the present invention is illustrated in a partially cut away "front" perspective view in FIG. 1 and is designated therein by the general reference character 10. The camera carrier 10 is intended to contain a conventional camera 12 and includes a generally rectangular case assembly 14 and a case lid 16. A belt assembly 18 is attached to the case assembly 14 for carrying the case assembly 14 thereby.

The case assembly 14 has a bottom 20, a front side wall 22, a left side wall 24, a rear side wall 26 and a right side wall 28. The belt assembly 18 has a left belt strap 30 and a right belt strap 32 attached to the case assembly 14 as will be described in more detail hereinafter.

The left belt strap 30 is removably joined to the right belt strap 32 by means of a buckle assembly 34. The buckle assembly 34 is a conventional buckle for joining the left belt strap 30 to the right belt strap 32 such that the chest pouch camera carrier 10 may be donned and removed from the photographer's person, and further for adjusting the overall length of the belt assembly 18 such that the chest pouch camera carrier 10 properly fits the photographer.

The case assembly 14 is made from a heavy canvas-like cloth outer shell 36 sewn to a smooth fabric lining 38. A thin foam pad 40 is contained between the shell 36 and the lining 38. The combination of the outer shell 36, the lining 38 and the foam pad 40 provides padding and protection for the camera 12 while leaving the case assembly 14 sufficiently flexible to be used as will be described hereinafter.

The case assembly 14 has two opposed adjustment strap assemblies 42, of which one is visible in the view of FIG. 1. The adjustment strap assemblies 42 are provided to cinch the camera 12 snugly within the case assembly 14. Since, as has been described heretofore, the case assembly 14 is somewhat flexible, cinching action of the adjustment strap assemblies 42 on the camera 14 is easily communicated through the case assembly 14 to the camera 12. Each of the adjustment strap assemblies 42 has a front strap portion 44 attached to the front side wall 22 of the case assembly 14 by means of a front attachment brace 46. The front attachment brace 46 is a roughly triangularly shaped cloth segment which, as can be seen in the view of FIG. 1 is attached so as to distribute forces applied to the front side wall 22 by the adjustment strap assemblies 42 across a wider area than would be the condition if the front attachment brace 46 were not present.

A rear strap portion 48 is attached to each of the edges 50 of the rear side wall 26, and is connected to the corresponding front strap portion 44 by means of a conventional double "D" ring 52. The double "D" rings 52 are conventional devices for making variable the overall length of the adjustment strap assemblies 42.

In the view of FIG. 1, one of a pair of belt attachment braces 54 is visible. One of the belt attachment braces 54 is connected to each of the edges 50 of the rear side wall 26, and further to the corresponding belt strap 30 or 32 such that tension from the belt straps 30 and 32 is distributed across the rear side wall 26. The belt attachment braces 54 are stiffening members made from a semi-rigid material which, in the instance of the best presently known embodiment 10 of the invention is a heavy plastic mesh material. The rigidity of the belt attachment braces 54 aids in preventing the case assembly 14 from sagging on the belt assembly 18 and further aids in preventing the belt assembly 18 from twisting in relation to the case assembly 14. On the best presently known embodiment 10 of the invention a pair of elastic film canister loops 56 are attached to each of the belt attachment braces 54. The film canister loops 56 are conventional loops of an elastic cloth material for holding one film canister 58 in each of the film canister loops 56.

The case lid 16 is removably attached to the case assembly 14, as will be discussed hereinafter. The case lid 16 is made from the same material as is the outer shell 36 of the case assembly 14, and is sufficiently flexible to easily be bent or formed over the top of the camera 12 even if the camera 12 might be somewhat taller than is the case assembly 14. A Velcro brand fastener hook strip closure 60 is attached to the front side wall 22 of the case assembly 14 so as to mate with a Velcro brand loop strip closure 62 which is on the underside of a lid opening tab 64. It should be noted that the hook strip closure 60 extends almost the entire height of the front side wall 22 such that the loop strip closure 62 may be attached anywhere along the length of the hook strip closure 60 such that the case lid 16 may be fastened so as to accommodate the camera 12 even when the camera 12 is, in fact, taller than is the case assembly 14. As can be appreciated, the hook strip closure 60 and the loop strip closure 62 could easily be interchanged on the best presently known embodiment 10 of the invention, or else they could be replaced with another conventional fastening means.

As can be seen in the view of FIG. 1, the case lid 16 is formed with a recessed area 66 on each side such that a neck strap 68 may be fastened to the camera 12 and may project from the case assembly 14 even when the case lid 16 is closed. This permits the neck strap 68 to be worn around the photographer's neck while the chest pouch camera carrier 10 is worn around the photographer's chest. Accordingly, when worn as described, the camera 12 is protected against being accidentally dropped by means of the neck strap 68 even when the photographer removes the camera 12 from the case assembly 14.

Figure 2:
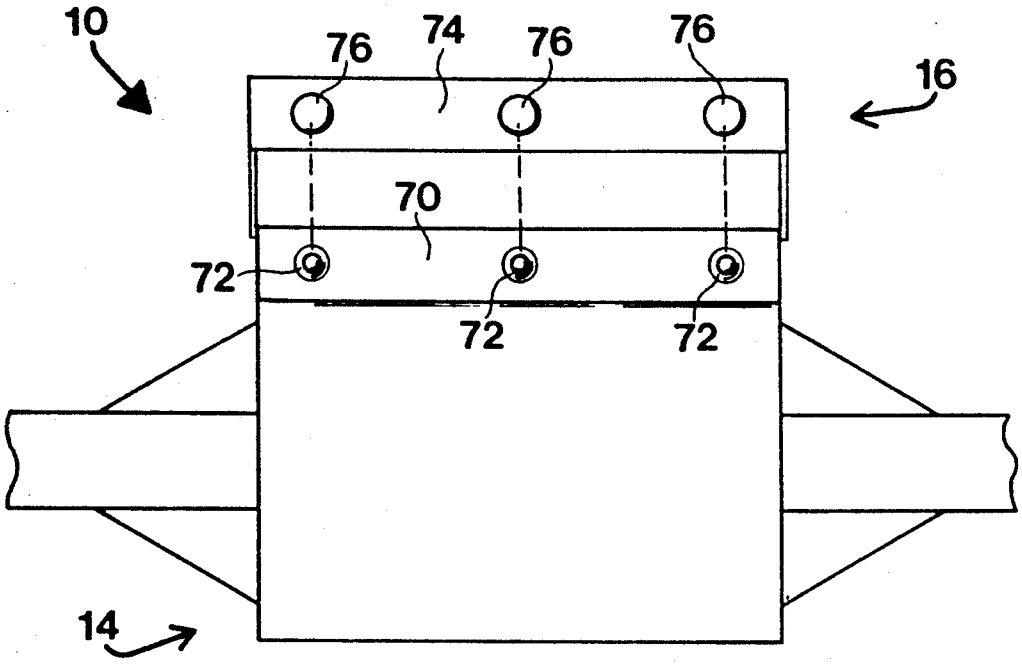
FIG. 2 is a rear elevational view of the chest pouch camera carrier of the present invention.

Referring now to FIG. 2, wherein is shown a "rear" elevational view of the chest pouch camera carrier 10, the case lid 16 is shown removed from the case assembly 14. A Velcro brand fastener hook lid fastener strip 70 is attached across the top rear the case assembly 14, as is shown in the drawing, and three conventional male snap halves 72 are attached thereon. A rear flap portion 74 of the case lid 16 has attached therethrough three female snap halves 76.

Figure 3:
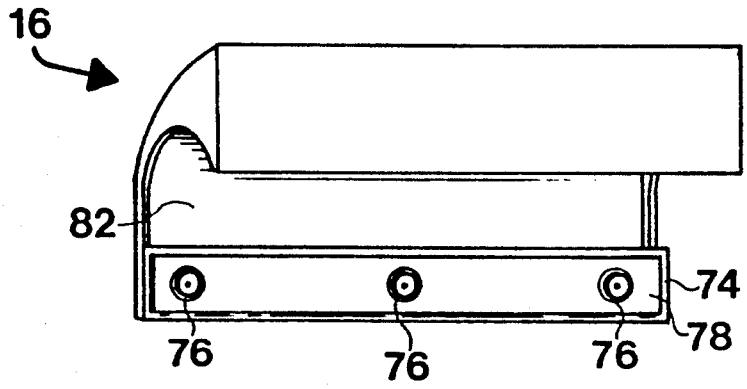
FIG. 3 is a front perspective view of the case lid of the chest pouch camera carrier of the present invention.

FIG. 3 is a "front" perspective view of the case lid 16 showing the interior of the rear flap portion 74. In the view of FIG. 3 it can be seen that inside the rear flap portion 74 of the lid 16 is a Velcro brand fastener loop lid fastener strip 78 with the female snap halves 76 projecting therethrough. In order to attach the case lid 16 to the case assembly 14 (FIG. 2), the loop lid fastener strip 78 (FIG. 3) within the rear flap portion 74 of the case lid 16 is mated to the hook lid faster strip 70 (FIG. 2) on the case assembly 14, and the female snap halves 76 (FIG. 3) are snapped onto the male snap halves 72 (FIG. 2).

It should be noted that a primary purpose of making the case lid 16 detachable from the case assembly 14 at both the front side wall 22 and the rear side wall 26, as has been heretofore described, is to allow the case lid 16 to be completely detached from the case assembly 14, an application of which will be discussed hereinafter. However, this arrangement also allows the photographer to detach the case lid 16 only from the rear side wall 26 and to open the case lid 16 by hinging it away from the rear side wall 26 when this is convenient.

Figure 4:
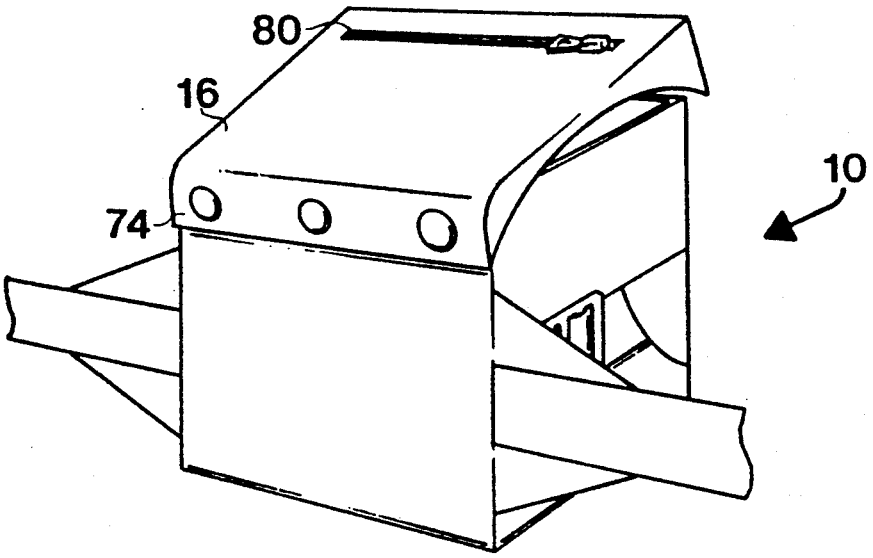
FIG. 4 is a rear perspective view of the chest pouch camera carrier of the present invention.

FIG. 4 is a "rear" perspective view of the chest pouch camera carrier 10 showing the rear flap portion 74 of the case lid 16 mated to the case assembly 14, as has been described herein. Also in the view of FIG. 4 it can be seen that, in the best presently known embodiment 10 of the invention, a zipper 80 is provided in the top of the case lid 16. Referring now again to FIG. 3, a lid liner 82 is sewn onto the inside of the case lid 16 such that space between the case lid 16 and the lid liner 82 may be used as a storage pocket for small items with access thereto provided by means of the zipper 80 (FIG. 4).

As is shown above, in great part, the chest pouch camera carrier 10 according to the present invention closely resembles prior art conventional camera carriers in many respects. Among the substantial differences are the inclusion of the adjustment strap assemblies 42 for causing the inventive camera carrier 10 to closely support the camera 12, the belt assembly 18 adapted such that the chest pouch camera carrier 10 can be worn about a photographer's chest or waist, and the recessed areas 66 of the case lid 16 adapted for allowing the neck strap 68 of the camera 12 to protrude from the chest pouch camera carrier 10 while the case lid 16 is closed, and further in the removable lid 16 which enhances the versatility of the inventive chest pouch camera carrier 10, as will be described hereinafter in relation to the industrial applicability of the invention. No significant changes of materials are envisioned nor are any special constructions required.

Various modifications may be made to the invention without altering its value or scope. For example, various individual aspects of the inventive combination might be deleted for the sake of economy. For instance, even were the case lid 16 not removable, as has been described herein, the utility of the invention would remain.

Another conceivable change would be to modify the belt assembly 18 so as to make it removable from the case assembly 14 and to add means for attaching a shoulder strap to the case assembly 14.

Yet another conceivable change would be to vary the non-inventive aspects of the invention so as to create a device quite dissimilar in appearance from the best presently known embodiment 10 of the present invention described herein, while retaining the unique aspects of the invention.

All of the above are only some of the examples of available embodiments of the present invention. Those skilled in the art will readily observe that numerous other modifications and alterations may be made without departing from the spirit and scope of the invention. Accordingly, the above disclosure is not intended as limiting and the appended claims are to be interpreted as encompassing the entire scope of the invention.

INDUSTRIAL APPLICABILITY

The inventive chest pouch camera carrier 10 is adapted to be widely used in the field of photography. The predominant current expected usages are for outdoor field usages wherein a photographer is engaged in physical activity such as bicycling or climbing, and for those applications wherein only a single camera is needed.

The chest pouch camera carrier 10 of the present invention may be utilized in any application wherein conventional camera cases are used. The main areas of improvement are in the unique case assembly 14, case lid 16, adjustment strap assemblies 42 and belt assembly 18 which, in associative combination, permit the inventive camera carrier 10 to be used as a chest carrier with the added protection provided by a padded case assembly 14, the added convenience of storage capacity for small accessory items, the added safety of a having the camera neck strap 68 in place while the camera 12 is within the chest pouch camera carrier 10 and the added versatility of being able to closely support various sizes of cameras 12 without resorting to any additional components. Alternatively, the inventive camera carrier 10 can be worn about the waist of the photographer when quick access to the camera 12 is not a prime consideration.

To use the chest pouch camera carrier 10 in its primary intended mode, that being as a chest carrier, the camera 12 is placed in the case assembly 14 and the adjustment strap assemblies 42 are adjusted in length by means of the double "D" ring assemblies 52 so as to cause the case assembly 14 to fit snugly about the camera 12. By this means the camera 12 is held within the case assembly 14 in much the same manner as it would be within a custom fitted case (not shown), the difference being that the inventive case assembly 14 is easily adaptable to fit a wide variety of sizes of cameras 12. The chest pouch camera carrier 10 is then fastened about the photographer's chest by means of the belt assembly 18 and, if desired, the photographer can place the neck strap 68 of the camera 12 about his neck. In this configuration, the camera 12 may be quickly accessed in order to obtain photographs of fleeting events which might be missed if the camera 12 were less accessible.

The case lid 16 may optionally be put in place to prevent the camera 12 from accidentally falling out of the case assembly 14. If this is done, the neck strap 68 is allowed to protrude through the recessed areas 66 of the case lid 16. The lid opening tab 64 may be secured at any position along the length of the hook strip closure 60, as required to accommodate the camera 12. Alternatively, the photographer may choose to leave the case lid 16 off of the case assembly 14 to provide even quicker access to the camera 12. If the photographer does choose to use the case lid 16 in this configuration, the case lid 16 may be opened by detaching the case lid 16 from either the front side wall 22 or the rear side wall 26. In many instances, detachment of the case lid 16 from the rear side wall 26 may be preferable, since the case lid 16 can then be opened toward the front side wall 22 which aids in preventing the case lid 16 from obstructing access of the photographer to the interior of the case assembly 14.

No special preparation is required to wear the inventive camera carrier 10 about a photographer's waist, in the fashion of a "fanny pack". The camera 12 is placed in the case assembly 14 and the adjustment strap assemblies 42 are manipulated as previously described in relation to the use of the inventive camera carrier 10 as a chest carrier. The case lid 16 is fastened in place, and the inventive camera carrier 10 is fastened about the user's waist by means of the belt assembly 18. In this manner of usage, the camera case assembly 14 may be worn at the photographer's back or side it may, if desired, be moved around the photographer's waist to position the case assembly 14 at his front in order to gain access to the camera 12 therein.

It should be noted that while the inventive camera carrier 10 is being worn either about a photographer's waist or hip, additional camera accessory cases such as lens cases (not shown) and the like which may be equipped with belt loops may be carried on the belt assembly 18 of the camera carrier 10.

Figure 5:
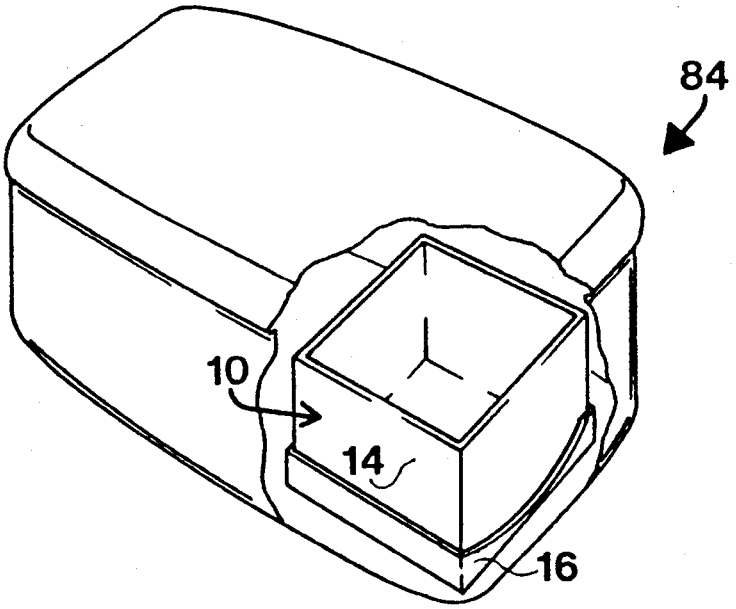
FIG. 5 is a partially cut away perspective view of a conventional camera bag showing therein the chest pouch camera carrier of the present invention.

Yet another mode of use of the inventive camera carrier 10 is as a component in a larger assortment of photography gear. FIG. 5 is a cut away perspective view of a large conventional camera bag 84 showing the chest pouch camera carrier 10 therein. In accordance with the present invention, the case lid 16 has been removed from the camera case assembly 14, and inserted thereunder prior to putting the chest pouch camera carrier 10 into the camera bag 84. Therefore, the camera case assembly 14 acts as a divider within the camera bag 84, providing additional protection for the camera 12 (not visible in the view of FIG. 5), while not hindering access thereto. The utility of the inventive chest pouch camera carrier 10 is greatly enhanced by its use in this manner, since it is always at hand within the camera bag 84 when needed.

Since the chest pouch camera carriers of the present invention may be readily constructed and are physically significantly similar to prior art conventional camera carriers it is expected that they will be acceptable in the industry as substitutes for the conventional camera carriers. For these and other reasons, it is expected that the utility and industrial applicability of the invention will be both significant in scope and long-lasting in duration.

We claim:

1. A camera carrier for carrying a camera therein, comprising:

a generally rectangular case enclosure for containing the camera within, said case enclosure having four flexible padded side walls;

at least one adjustment strap assembly attached to the side walls such that the volume of the case enclosure is variable according to the adjusted length of the adjustment strap; and a case lid attached to one of said side walls of the case enclosure such that said case lid hinges up from that side wall to permit access to the camera within the case enclosure, wherein said case lid is formed so as to provide a pair of recesses through which a camera neck strap may be passed such that said camera neck strap may be extended from the case enclosure through said recesses when the lid is closed over the enclosure.

2. The camera carrier of claim 1, wherein:

each adjustment strap assembly is attached at its ends between two opposing said side walls such that shortening the adjustment strap assemblies tend to draw said two opposing said side walls together.

3. The camera carrier of claim 1, wherein:

the quantity of the adjustment strap assemblies is two.

4. The camera carrier of claim 1, wherein:

the adjustment strap assembly includes;

a double "D" ring assembly;

a first strap assembly half; and a second strap assembly half;

said double "D" ring assembly being affixed to said first strap assembly half such that said second strap assembly half is passed through said double "D" ring assembly to connect said first strap half to said second strap half.

5. The camera carrier of claim 1, and further including:

a belt assembly attached to the case enclosure such that the case enclosure can be carried on a person's chest.

6. The camera carrier of claim 1, wherein:

said case lid is removably attached to said side wall of the case enclosure such that said case lid may be optionally removed from the case enclosure.

7. The camera carrier of claim 1, wherein:

said case lid is flexible such that it can be bent across the top of the camera should the camera protrude above said side walls of the case enclosure.

8. The camera carrier of claim 1, and further including:

a fastening means for fastening said case lid closed on the case enclosure, said fastening means being elongated in at least one dimension such that said case lid can be fastened against the camera when the camera protrudes above said sides of the case enclosure.

9. A device for carrying a camera comprising:

a generally rectangular soft sided padded case having a hollow interior cavity for holding the camera or other items therein;

a lid flexibly and removably attached to one side of the case such that the lid may be closed to enclose the contents of said cavity therein and opened to provide access to said contents;

a closure means for selectively holding the lid closed;

a belt attached to the case such that the case can be worn and carried by means of said belt; and at least one adjustment strap attached to the exterior of the case such that the case may be tightened upon the camera by means of the adjustment strap whether or not the lid is attached to the case, so as to prevent the camera from shifting its position within the case, wherein;

the lid is removably attached to the case by means of a Velcro brand fastener and further by means of a plurality of snaps.

10. The device of claim 9, wherein:

the belt is adjustable in length such that it may be worn by persons of different size and further such that it may be worn about a person's chest or waist.

11. The device of claim 9, wherein:

the lid is formed so as to permit a camera neck strap to extend outside the case from the camera while the lid is closed.

* * * * *